US006741226B2

(12) United States Patent
Shirasawa

(10) Patent No.: US 6,741,226 B2
(45) Date of Patent: May 25, 2004

(54) METHOD OF DRIVING PLASMA DISPLAY AND PLASMA DISPLAY

(75) Inventor: Hiroshi Shirasawa, Tokyo (JP)

(73) Assignee: NEC Corporation, Tokyo (JP)

( * ) Notice: Subject to any disclaimer, the term of this patent is extended or adjusted under 35 U.S.C. 154(b) by 280 days.

(21) Appl. No.: 09/984,582

(22) Filed: Oct. 30, 2001

(65) Prior Publication Data

US 2002/0050961 A1 May 2, 2002

(30) Foreign Application Priority Data

Oct. 30, 2000 (JP) ..... 2000-331184

(51) Int. Cl.[7] ..... G09G 3/28
(52) U.S. Cl. ..... 345/60; 345/211
(58) Field of Search ..... 345/60, 61, 62, 345/63, 66, 69, 70, 210, 211, 212, 204, 205; 315/169.4

(56) References Cited

U.S. PATENT DOCUMENTS 3,803,585 A * 4/1974 Urade et al. ..... 345/215
4,384,287 A * 5/1983 Sakuma ..... 345/60
4,496,879 A * 1/1985 Suste ..... 315/169.4
6,496,166 B1 * 12/2002 Onozawa et al. ..... 345/60

* cited by examiner

*Primary Examiner*—Xiao Wu
(74) *Attorney, Agent, or Firm*—Young & Thompson

(57) ABSTRACT

A plasma display capable of avoiding an increase in costs for manufacturing the plasma display by omitting use of a costly forced discharging circuit wherein electrical charges being left in an auxiliary high-voltage power source are discharged by detecting a drop in a voltage fed from a main high-voltage power source, while power is OFF, and changing a method of driving an X driver.

26 Claims, 5 Drawing Sheets

METHOD OF DRIVING PLASMA DISPLAY AND PLASMA DISPLAY

BACKGROUND OF THE INVENTION

1. Field of the Invention

The present invention relates to a method for driving a plasma display and to a plasma display and more particularly to the method for driving the plasma display which is capable of avoiding an increase in costs for manufacturing the plasma display by omitting use of a costly forced-discharging circuit which is made possible by detecting, while power is off, a drop in a voltage fed from a main high-voltage power source and by changing a method of driving an X driver to cause an electric charge being left in an auxiliary high-voltage power source to be discharged, and to the plasma display.

The present application claims priority of Japanese Patent Application No. 2000-331184 filed on Oct. 30, 2000, which is hereby incorporated by reference.

2. Description of the Related Art

FIG. 4 is a diagram of a functional block explaining a conventional plasma display. In FIG. 4, there are provided an X driver 14, a signal control circuit 16, a voltage detecting circuit 17, a forced discharging circuit 18, contacts 21, 22, 23, and 24, lines for transmitting signals 31, 32, and 33, capacitors C1 and C2, a diode D1, ground potential terminals GND, a MOSFET M3 (Metal Oxide Semiconductor Field Effect Transistor), resistors R1, R2, and R3, an auxiliary high-voltage power source Vp and a main high-voltage power source Vs.

In the conventional plasma display as shown in FIG. 4, when any preventive measure against sequences in which power from a low-voltage power source Vcc (not shown), the main high-voltage power source Vs, and the auxiliary high-voltage power source Vp is turned OFF is not taken while the power is OFF, if the power from the low voltage power source Vcc (not shown) is turned OFF before the power from the main high-voltage power source Vs and auxiliary high-voltage power source Vp is turned OFF, a gate potential of a MOSFET (for example, a MOSFET M1 and a MOSFET M2 making up the X driver 14) being used in a high-voltage system reaches a level of floating, which causes a feed through current to flow in the MOSFET M1 and the MOSFET M2 due to noises or a like and also causes the MOSFET M1 and the MOSFET M2 to be damaged, in some cases. Conventionally, in order to protect circuits in a high-voltage system, a forced discharging circuit is provided to the main high-voltage power source Vs and the auxiliary high-voltage power source Vp and the power from the main high-voltage power source Vs and from the auxiliary high-voltage power source Vp is turned OFF before the power from the low-voltage power source Vcc (not shown) is turned OFF.

In the conventional method, as described above, to protect circuits in the high-voltage system, the forced discharging circuit 18 made up of the MOSFET M3 and the resistor R3 is provided. A drain of the MOSFET M3 is connected to the auxiliary high-voltage power source Vp, its gate is connected to the line for transmitting signals 33 and the resistor R3 is connected between the contact 24 and the ground potential terminal GND.

Moreover, a drain of the MOSFET M1 is connected through the contact 21 and the diode D1 to the auxiliary high-voltage power source Vp and the capacitor C1, its gate is connected to the signal control circuit 16 line for transmitting signals 31 and its source is connected to a drain of the MOSFET M2.

The drain of the MOSFET M2 is connected through the contact 22 to the source of MOSFET Ml and the capacitor C2 and its gate is connected to the line for transmitting signals 32, and its source is connected to the ground potential terminal GND.

The voltage detecting circuit 17 is mounted so as to detect a voltage at the contact 23 disposed between the resistor R1 connected to the main-high voltage power source Vs and the resistor R2 connected to the ground potential terminal GND.

FIG. 5 is a timing chart explaining operations of the conventional plasma display of FIG. 4. In FIG. 5, "T1" indicates a first time, "T2" indicates a second time, "T5" indicates a fifth time and "T6" indicates a sixth time.

Referring to FIG. 5, in the conventional plasma display, when the power is turned OFF at the first time T1, a voltage fed from the main high-voltage power source Vs (see FIG. 4) begins to drop and, when a voltage at the contact 23 reaches a predetermined voltage set by the voltage detecting circuit 17 at the second time T2, the voltage detecting circuit 17 operates to output to the line for transmitting signals 33. When the signal 33 goes high, the forced discharging circuit 18 operates and the voltage fed from the auxiliary high-voltage power source Vp becomes 0 (zero) at the fifth time T5. Then, after a lapse of the time set at a time when the power is turned OFF, at the sixth time T6 (T6>T5), the voltage fed from the low-voltage power source Vcc (not shown) is lowered to 0 (zero) volts.

However, in the conventional method, since the forced discharging circuit 18 is introduced and the power from the main high-voltage power source Vs and the auxiliary high-voltage power source Vp is turned OFF before the power from the low-voltage power source Vcc (not shown) is turned OFF, though the damage in the MOSFET M1 and the MOSFET M2 can be avoided, introduction of an expensive forced discharging circuit causes manufacture of a PDP (Plasma Display Panel) to be costly.

SUMMARY OF THE INVENTION

In view of the above, it is an object of the present invention to provide a method for driving a plasma display which is capable of avoiding an increase in costs for manufacturing the plasma display by detecting a drop in a voltage fed from a main high-voltage while power is OFF and by changing a method for driving an X driver to cause an electric charge being residual in an auxiliary high-voltage power source to be discharged, thereby enabling an omission of use of a costly forced discharging circuit, and to provide the above plasma display.

According to a first aspect of the present invention, there is provided a method for driving a plasma display including a power source used to produce power from a low-voltage power source and a main high-voltage power source and a display section having a plasma display panel, an X driver and a Y driver each being used to drive the plasma display panel, a signal control circuit, a voltage detecting circuit used to detect a voltage fed from the main high-voltage power source and an auxiliary high-voltage power source, the method including:

a step of detecting a state of power-off by using the voltage detecting circuit used to detect a voltage fed from the main high-voltage power source while power is off and operating the X driver or the Y driver used to drive the plasma display panel to discharge electrical charges being left in the auxiliary high-voltage power source.

In the foregoing, a preferable mode is one that wherein includes a step of detecting a drop in a voltage fed from the main high-voltage power source while power is off and changing a method of driving the X driver to discharge the electrical charges being left in the auxiliary high-voltage power source.

Also, a preferable mode is one that wherein includes a step of detecting a drop in a voltage fed from the main high-voltage power source while power is off and changing a method of driving the Y driver to discharge the electrical charges being left in the auxiliary high-voltage power source.

Also, a preferable mode is one that wherein includes:

a step of stopping a supply of power fed from the main high-voltage power source and the auxiliary high-voltage power source when power is turned off at a first time and maintaining a voltage by using electrical charges being left in a capacitor for smoothing mounted in the main high-voltage power source and the auxiliary high-voltage power source;

a step of causing the voltage detecting circuit to operate to output a first signal when a voltage fed from the main high-voltage power source drops and a voltage at a first contact reach a level predetermined by the voltage detecting circuit;

a step of causing the signal control circuit having received the first signal to repeatedly produce a second signal and a third signal being out of phase with each other;

a step of causing a first MOSFET (Metal Oxide Semiconductor Field Effect Transistor) to be turned ON when the second signal goes high at a third time, which causes a voltage level at a second contact and a level of a voltage fed from the auxiliary high-voltage power source to reach {electrostatic capacity of the capacitor for smoothing mounted in the auxiliary high-voltage power source} multiplied by {potential of the auxiliary high-voltage power source} divided by ({electro static capacity of the capacitor for smoothing mounted in the auxiliary high-voltage power source} added to {electrostatic capacity of the capacitor for smoothing mounted in the main high-voltage power source}); and a step of causing a second MOSFET to be turned ON when the third signal goes high at a fourth time, which causes the second contact to be discharged and a voltage at the second contact to reach a level of a ground potential, and when the operation is repeated, a voltage fed from the auxiliary high-voltage power source gradually drops and reaches 0 (zero) volts at a fifth time and, after a lapse of the time set at a time when power is turned off, a voltage fed from the low-voltage power source is lowered to 0 (zero) volts at a sixth time.

According to a second aspect of the present invention, there is provided a plasma display including:

a power source used to produce power from a low-voltage power source and a main high-voltage power source;

a display section having a plasma display panel, an X driver and a Y driver each being used to drive the plasma display panel, a signal control circuit, a voltage detecting circuit used to detect a voltage fed from the main high-voltage power source and an auxiliary high-voltage power source; and wherein a state of power-off is detected by using the voltage detecting circuit used to detect a voltage fed from the main high-voltage power source while power is off and the X driver or the Y driver used to drive the plasma display panel operates to discharge electrical charges being left in the auxiliary high-voltage power source.

Also, a preferable mode is one wherein a drop in a voltage fed from the main high-voltage power source is detected while power is off and a method of driving the X driver is changed to discharge the electrical charges being left in the auxiliary high-voltage power source.

Also, a preferable mode is one wherein a drop in a voltage fed from the main high-voltage power source is detected while power is off and a method of driving the Y driver is changed to discharge the electrical charges being left in the auxiliary high-voltage power source.

Furthermore, a preferable mode is one wherein a supply of power fed from the main high-voltage power source and the auxiliary high-voltage power source is stopped when power is turned off at a first time and a voltage is maintained by using electrical charges being left in a capacitor for smoothing mounted in the main high-voltage power source and the auxiliary high-voltage power source and wherein the voltage detecting circuit operates to output a first signal after a voltage fed from the main high-voltage power source drops and a voltage at a first contact reach a level predetermined by the voltage detecting circuit and wherein the signal control circuit having received the first signal repeatedly produces a second signal and a third signal being out of phase with each other, and wherein a first MOSFET (Metal Oxide Semiconductor Field Effect Transistor) is turned ON when the second signal goes high at a third time, which causes a voltage level at a second contact and a level of a voltage fed from the auxiliary high-voltage power source to reach {electrostatic capacity of the capacitor for smoothing mounted in the auxiliary high-voltage power source} multiplied by {potential of the auxiliary high-voltage power source} divided by ({electrostatic capacity of the capacitor for smoothing mounted in the auxiliary high-voltage power source} added to {electrostatic capacity of the capacitor for smoothing mounted in the main high-voltage power source}), and wherein a second MOSFET is turned ON when the third signal goes high at a fourth time, which causes the second contact to be discharged and a voltage at the second contact to reach a level of a ground potential, and when the operation is repeated, a voltage fed from the auxiliary high-voltage power source gradually drops and reaches 0 (zero) volts at a fifth time and, after a lapse the time set at a time when power is turned off, the voltage fed from the low-voltage power source is lowered to 0 (zero) volts at a sixth time.

With the above configurations, while the power is OFF, by using the circuit used to drive the plasma display panel, the voltage fed from the auxiliary high-voltage power source can be lowered to the ground potential before the voltage fed from the low-voltage becomes the ground level and therefore the use of the costly forced discharging circuit becomes unnecessary which thus enables the cost-reduction to be achieved.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

Conventionally, a method is employed in which a forced discharging circuit is introduced to protect circuits in high-voltage systems and a voltage fed from a high-voltage power source is lowered to a ground level before a voltage fed from a low-voltage power source Vcc reaches the ground level while power is OFF.

In contrast, in the present invention, the above functions can be implemented without use of such costly forced discharging circuit and, as a result, cost-reduction can be achieved. Embodiments will be described below.

First Embodiment

Figure 1:
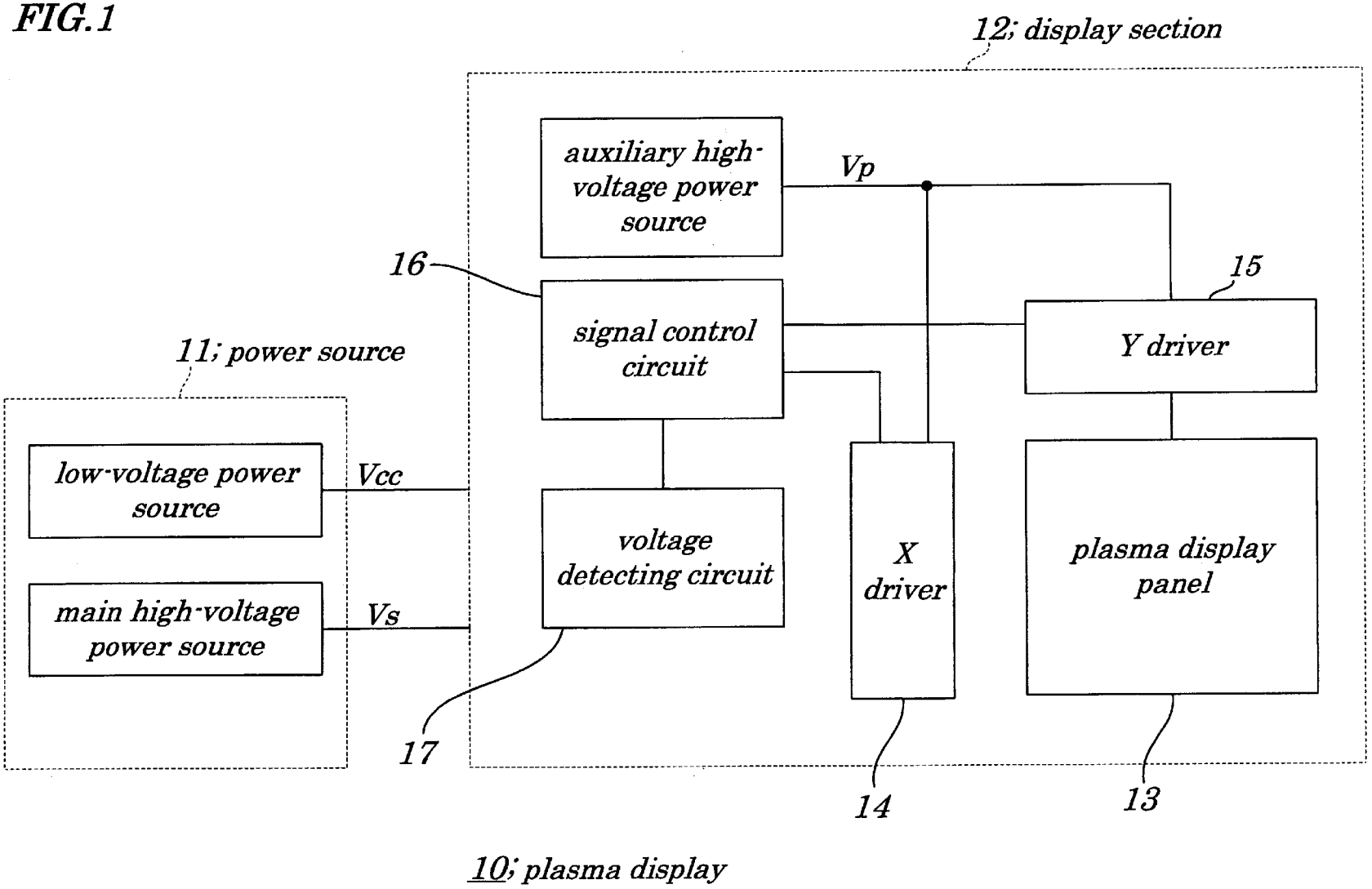
FIG. 1 is a diagram of a functional block explaining a plasma display according to a first embodiment of the present invention.

FIG. 1 is a diagram of a functional block explaining a plasma display according to a first embodiment. As shown in FIG. 1, a plasma display 10 of the first embodiment includes a power source 11, a display section 12, a plasma display panel (PDP 13), an X driver 14, a Y driver 15, a signal control circuit 16, a voltage detecting circuit 17, a low-voltage power source Vcc, an auxiliary high-voltage power source Vp, and a main high-voltage power source Vs.

As shown in FIG. 1, the plasma display 10 of the first embodiment chiefly includes the power source 11 having the low-voltage power source Vcc and the main high-voltage power source Vs which produces a low voltage power source Vcc and a main high-voltage power source Vs, and the display section 12.

The display section 12 mainly includes the plasma display panel (PDP 13), the X driver 14 to drive the PDP 13, the Y driver 15 to drive the PDP 13, the signal control circuit 16, the voltage detecting circuit 17 used to detect a voltage fed from the main high-voltage power source Vs, and the auxiliary high-voltage power source Vp.

Figure 2:
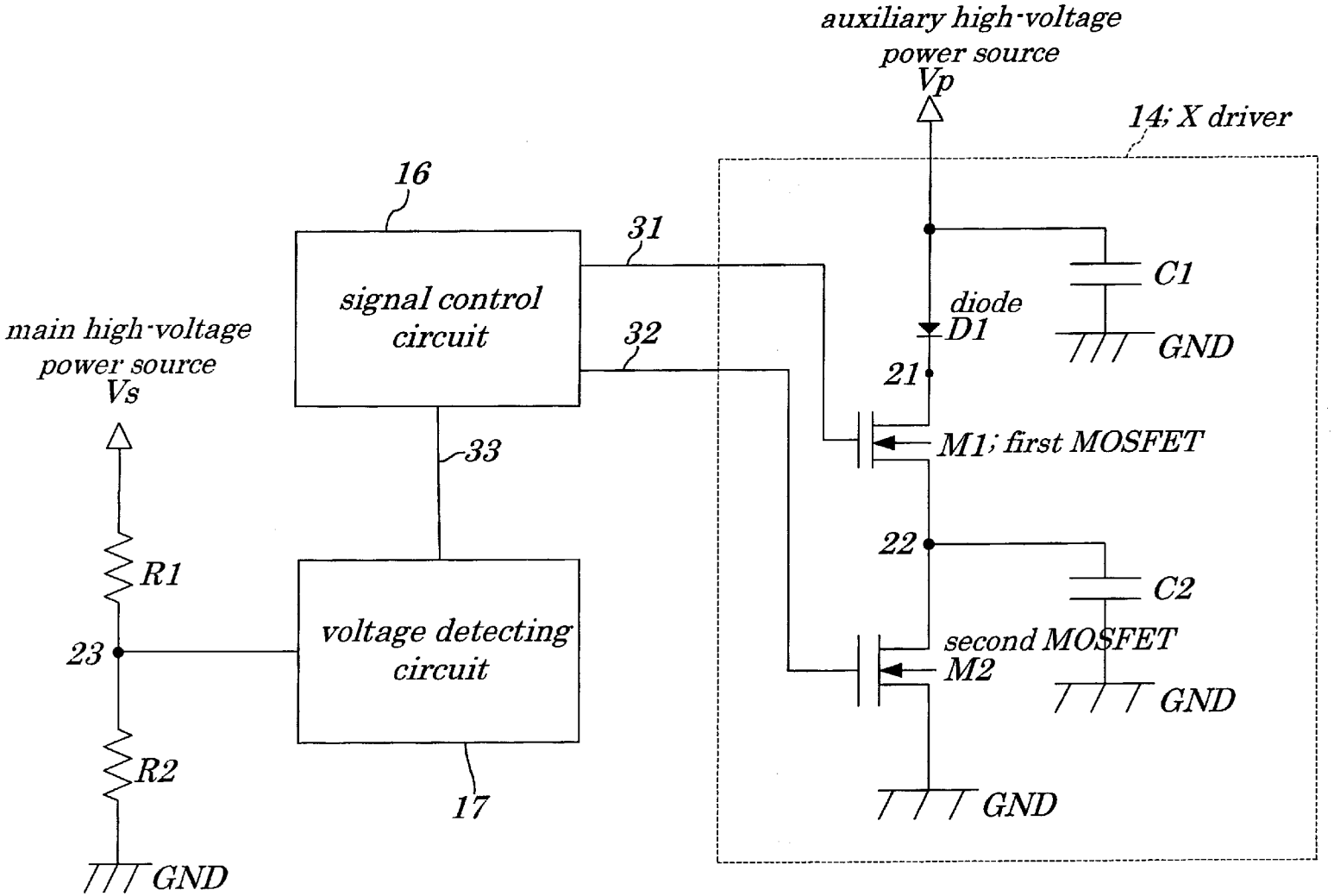
FIG. 2 is a diagram of a functional block explaining main components of the plasma display according to the first embodiment of the present invention.

FIG. 2 is a diagram of a functional block explaining main components of the plasma display 10 according to the first embodiment. As shown in FIG. 2, the X driver 14 chiefly includes the diode D1, the first MOSFET M1 and the second MOSFET M2.

A drain of the first MOSFET M1 is connected through the contact 21 to a cathode of the diode D1. A gate of the first MOSFET M1 is connected through a line transmitting the signal 31 (second signal) to the signal control circuit 16. A source of the first MOSFET M1 is connected through the second contact 22 to the second MOSFET M2 and to the capacitor C2.

To the auxiliary high-voltage power source Vp is connected the capacitor Cl for smoothing. The second contact 22 is connected to an X electrode (not shown) of the PDP 13. In the embodiment, a capacity of the second contact 22 (including electrostatic capacity of the X electrode in the PDP 13) is indicated by the capacitor C2.

The diode D1 is connected to the auxiliary high-voltage power source Vp and the contact 21. An anode of the diode D1 is connected to one terminal of the auxiliary high-voltage power source Vp and one terminal of the capacitor C1. Another terminal of the capacitor C1 is connected to a GND terminal.

A drain of the second MOSFET M2 is connected to the second contact 22. A gate of the second MOSFET M2 is connected to the line transmitting the third signal 32. A source of the second MOSFET M2 is connected to a GND terminal.

Between the main high-voltage power source Vs and a GND terminal are connected the resistors R1 and R2 in series. An input terminal of the voltage detecting circuit 17 is connected to the first contact 23 disposed between the resistor R1 and the resistor R2 and the first signal 33 is output from the input terminal of the voltage detecting circuit 17.

The signal control circuit 16 receives the first signal 33 from the voltage detecting circuit 17 and outputs the second signal 31 to the gate of the first MOSFET Ml and the third signal 32 to the gate of the second MOSFET M2.

Figure 3:
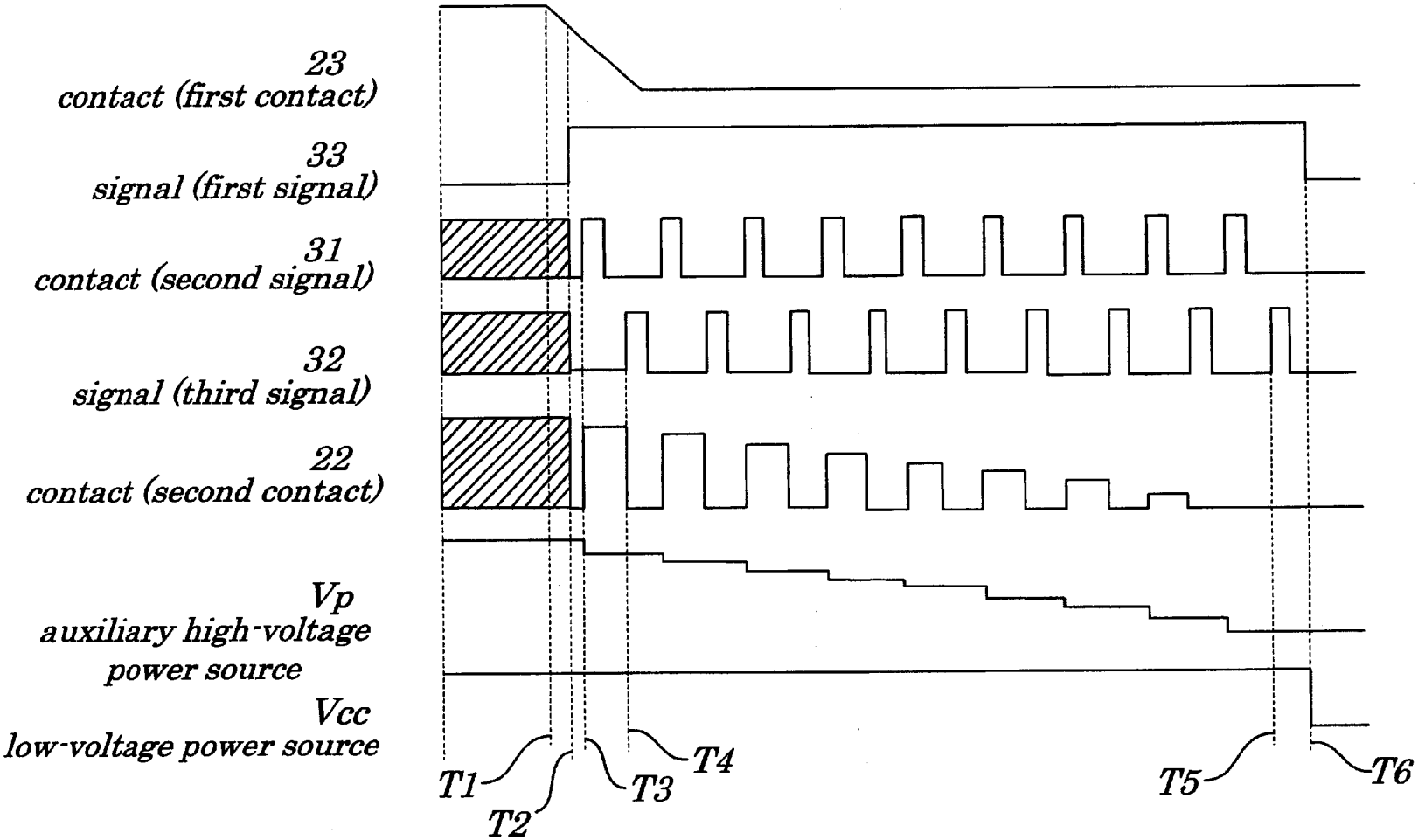
FIG. 3 is a timing chart explaining operations of the plasma display according to the first embodiment of the present invention.
Figure 4:
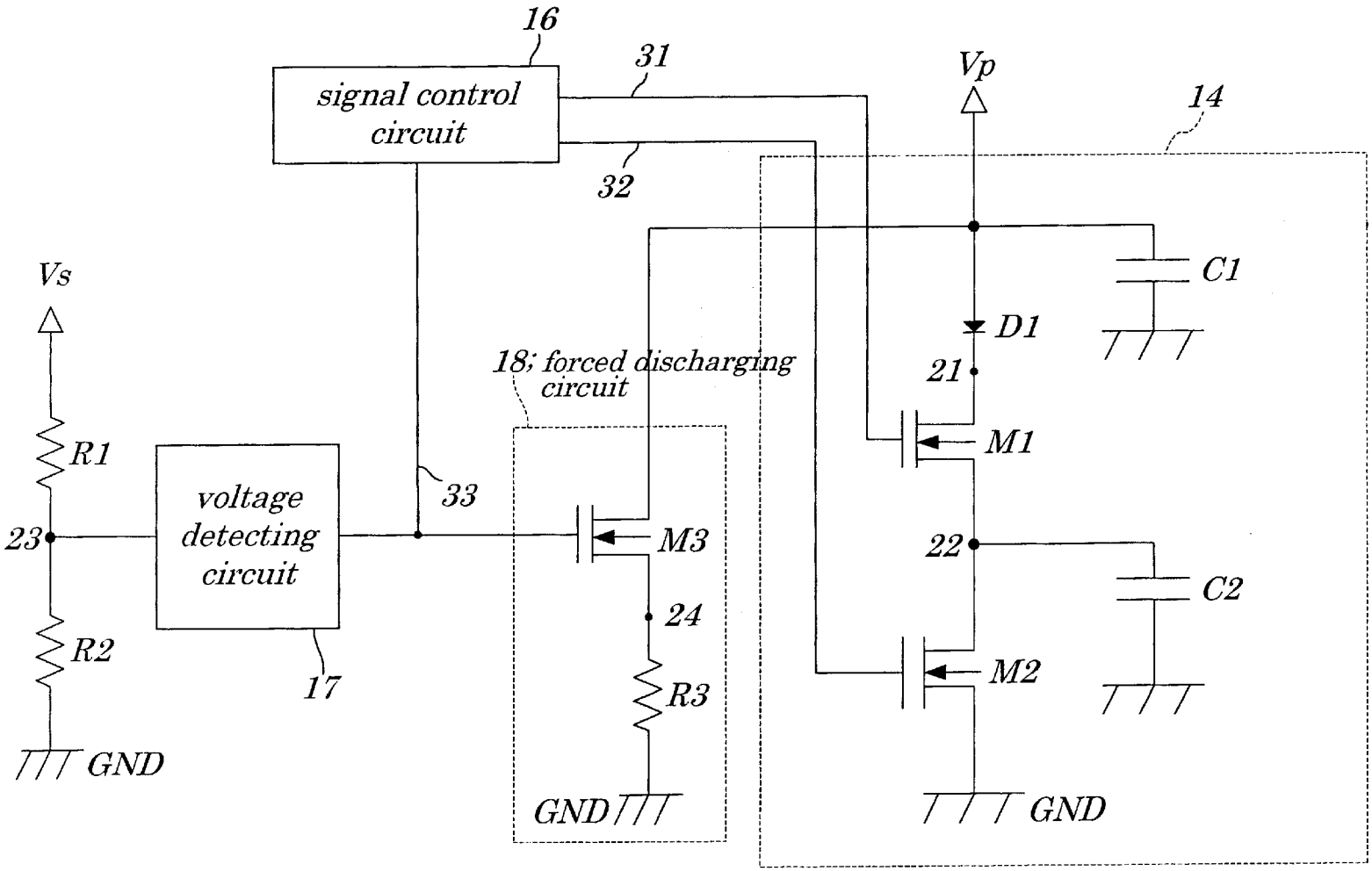
FIG. 4 (PRIOR ART)
FIG. 4 is a diagram of a functional block explaining a conventional plasma display.
Figure 5:
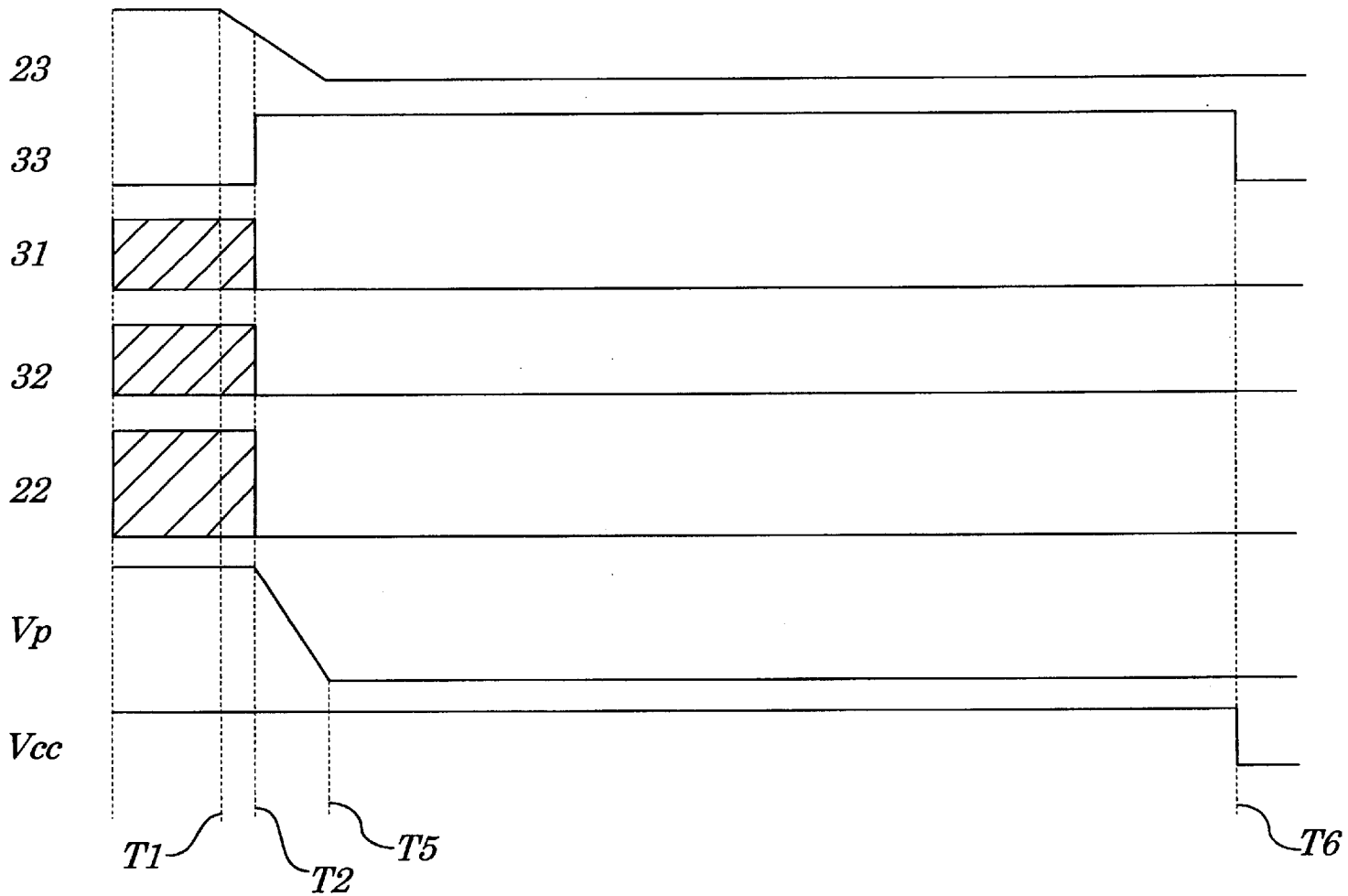
FIG.5 (PRIOR ART)
FIG. 5 is a timing chart explaining operations of the conventional plasma display of FIG. 4.

Next, operations (the method for driving the plasma display 10) of the plasma display 10 of the embodiment will be described. FIG. 3 is a timing chart explaining operations of the plasma display 10 according to the first embodiment.

In FIG. 3, "T1" indicates a first time, "T2" indicates a second time, "T3" indicates a third time, "T4" indicates a fourth time, "T5" indicates a fifth time, and "T6" indicates a sixth time.

As shown in FIG. 3, in the embodiment, when power is turned OFF at the first time T1, supply of the power fed from the main high-voltage power source Vs and from the auxiliary high-voltage power source Vp is stopped and the voltage is maintained by an electric charge being left in the capacitor C1 for smoothing mounted in each of the power sources.

When a voltage fed from the main high-voltage power source Vs drops and when a voltage at the first contact 23 at the second time T2 (100 ns) reaches a level predetermined by the voltage detecting circuit 17, the voltage detecting circuit 17 starts operations to output the first signal 33. The time indicated by brackets shows the time elapsed after the first time T1.

The signal control circuit 16 having received the first signal 33 repeatedly produces the second signal 31 and the third signal 32 being out of phase with each other.

At the third time T3 (200 ns), when the second signal 31 goes high, the first MOSFET M1 is turned ON, causing a voltage across the second contact 22 and the auxiliary high-voltage power source Vp to reach a level of C1·Vp/(C1+C2).

At the fourth time T4 (300 ns), when the third signal 32 goes high, the second MOSFET M2 is turned ON, causing the second contact 22 to be discharged and its voltage to be a ground potential level. When the operation is repeated, the voltage level of the auxiliary high-voltage power source Vp lowers gradually and, at the fifth time T5 (100 ms), becomes 0 (zero). Then, after a lapse of the time set at a time when the power is turned OFF, at the sixth time T6 (200 ms), the voltage fed from the low-voltage power source Vcc is lowered to 0 (zero) volts.

As described above, according to the first embodiment, while the power is OFF, by using the circuit used to drive the PDP, it is made possible to lower the voltage fed from the auxiliary high-voltage power source Vp to a ground potential level before the voltage fed from the low-voltage power source Vcc becomes the ground potential level and, therefore, the use of a costly forced discharging circuit becomes unnecessary, thus achieving cost-reduction. In the first embodiment, though addition of the circuit used to drive the X driver 14 to the signal control circuit 16 is required, since the signal control circuit 16 is constructed of a gate array or a programmable logic array, it does not cause an increase in costs.

Second Embodiment

In the second embodiment, same reference numbers are assigned to components having same functions as in the first embodiment and their descriptions are omitted.

In the first embodiment, an X driver 14 operates to discharge electric charges being left in an auxiliary high-voltage power source Vp and, in the second embodiment, a Y driver 15 (see FIG. 1) operates to discharge electric charges in the same manner as in the case of the first embodiment.

It is apparent that the present invention is not limited to the above embodiments but may be changed and modified without departing from the scope and spirit of the invention. For example, the present invention may be applied, in addition to a plasma display described in the above embodiments, to other general display devices having capacitive loads. Moreover, number, mounting place, shape or a like of each of the components are not limited to the examples in the above embodiments and they may be arbitrary so long as they are appropriate to carry out the present invention.

What is claimed is:

1. A method for driving a plasma display including a power source used to produce power from a low-voltage power source and a main high-voltage power source and a display section having a plasma display panel, an X driver and a Y driver each being used to drive said plasma display panel, a signal control circuit, a voltage detecting circuit used to detect a voltage fed from said main high-voltage power source and an auxiliary high-voltage power source, said method comprising:

a step of detecting a state of power-off by using said voltage detecting circuit used to detect a voltage fed from said main high-voltage power source while power is off and operating said X driver or said Y driver used to drive said plasma display panel to discharge electrical charges being left in said auxiliary high-voltage power source through a resistor-free path.

2. The method for driving the plasma display according to claim 1, further including a step of detecting a drop in a voltage fed from said main high-voltage power source while power is off and changing a method of driving said X driver to discharge said electrical charges being left in said auxiliary high-voltage power source.

3. The method for driving the plasma display according to claim 1, further including a step of detecting a drop in a voltage fed from said main high-voltage power source while power is off and changing a method of driving said Y driver to discharge said electrical charges being left in said auxiliary high-voltage power source.

4. The method for driving the plasma display according to claim 2, further comprising:

a step of stopping a supply of power fed from said main high-voltage power source and said auxiliary high-voltage power source when power is turned off at a first time and maintaining a voltage by using electrical charges being left in a capacitor for smoothing mounted in said main high-voltage power source and said auxiliary high-voltage power source;

a step of causing said voltage detecting circuit to operate to output a first signal when a voltage fed from said main high-voltage power source drops and a voltage at a first contact reach a level predetermined by said voltage detecting circuit;

a step of causing said signal control circuit having received said first signal to repeatedly produce a second signal and a third signal being out of phase with each other;

a step of causing a first MOSFET (Metal Oxide Semiconductor Field Effect Transistor) to be turned ON when said second signal goes high at a third time, which causes a voltage level at a second contact and a level of a voltage fed from said auxiliary high-voltage power source to reach {electrostatic capacity of said capacitor for smoothing mounted in said auxiliary high-voltage power source} multiplied by {potential of said auxiliary high-voltage power source} divided by ({electrostatic capacity of said capacitor for smoothing mounted in said auxiliary high-voltage power source} added to {electrostatic capacity of said capacitor for smoothing mounted in said main high-voltage power source}); and a step of causing a second MOSFET to be turned ON when said third signal goes high at a fourth time, which causes said second contact to be discharged and a voltage at said second contact to reach a level of a ground potential, and when said operation is repeated, a voltage fed from said auxiliary high-voltage power source gradually drops and reaches 0 (zero) volts at a fifth time and, after a lapse of the time set at a time when power is turned off, a voltage fed from said low-voltage power source is lowered to 0 (zero) volts at a sixth time.

5. The method for driving the plasma display according to claim 3, further comprising:

a step of stopping a supply of power fed from said main high-voltage power source and said auxiliary high-voltage power source when power is turned off at a first time and maintaining a voltage by using electrical charges being left in a capacitor for smoothing mounted in said main high-voltage power source and said auxiliary high-voltage power source;

a step of causing said voltage detecting circuit to operate to output a first signal when a voltage fed from said main high-voltage power source drops and a voltage at a first contact reach a level predetermined by said voltage detecting circuit;

a step of causing said signal control circuit having received said first signal to repeatedly produce a second signal and a third signal being out of phase with each other;

a step of causing a first MOSFET (Metal Oxide Semiconductor Field Effect Transistor) to be turned ON when said second signal goes high at a third time, which causes a voltage level at a second contact and a level of a voltage fed from said auxiliary high-voltage power source to reach {electrostatic capacity of said capacitor for smoothing mounted in said auxiliary high-voltage power source} multiplied by {potential of said auxiliary high-voltage power source} divided by ({electrostatic capacity of said capacitor for smoothing mounted in said auxiliary high-voltage power source} added to {electrostatic capacity of said capacitor for smoothing mounted in said main high-voltage power source}); and a step of causing a second MOSFET to be turned ON when said third signal goes high at a fourth time, which causes said second contact to be discharged and a voltage at said second contact to reach a level of a ground potential, and when said operation is repeated, a voltage fed from said auxiliary high-voltage power source gradually drops and reaches 0 (zero) volts at a fifth time and, after a lapse of the time set at a time when power is turned off, a voltage fed from said low-voltage power source is lowered to 0 (zero) volts at a sixth time.

6. The method of claim 1, wherein said X driver or said Y driver is used to drive said plasma display panel to discharge electrical charges, being left in said auxiliary high-voltage power source, by using electrical charges left in a capacitor for smoothing mounted in said main high-voltage power source and said auxiliary high-voltage power source.

7. The method of claim 1, wherein said X driver or said Y driver is used to drive said plasma display panel to discharge electrical charges, being left in said auxiliary high-voltage power source, by using electrical charges stored in a capacitor.

8. The method of claim 1, wherein said X driver or said Y driver, used to drive said plasma display panel, operates to discharge electrical charges being left in said auxiliary high-voltage power source by using electrical charges stored in a capacitor.

9. A method for driving a plasma display including a power source used to produce power from a low-voltage power source and a main high-voltage power source and a display section having a plasma display panel, an X driver and a Y driver each being used to drive said plasma display panel, a signal control circuit, a voltage detecting circuit used to detect a voltage fed from said main high-voltage power source and an auxiliary high-voltage power source, said method comprising:

a step of detecting a state of power-off by using said voltage detecting circuit used to detect a voltage fed from said main high-voltage power source while power is off and operating said X driver or said Y driver used to drive said plasma display panel to discharge electrical charges being left in said auxiliary high-voltage power source;

a step of stopping a supply of power fed from said main high-voltage power source and said auxiliary high-voltage power source when power is turned off at a first time and maintaining a voltage by using electrical charges being left in a capacitor for smoothing mounted in said main high-voltage power source and said auxiliary high-voltage power source;

a step of causing said voltage detecting circuit to operate to output a first signal when a voltage fed from said main high-voltage power source drops and a voltage at a first contact reach a level predetermined by said voltage detecting circuit;

a step of causing said signal control circuit having received said first signal to repeatedly produce a second signal and a third signal being out of phase with each other;

a step of causing a first MOSFET (Metal Oxide Semiconductor Field Effect Transistor) to be turned ON when said second signal goes high at a third time, which causes a voltage level at a second contact and a level of a voltage fed from said auxiliary high-voltage power source to reach {electrostatic capacity of said capacitor for smoothing mounted in said auxiliary high-voltage power source} multiplied by {potential of said auxiliary high-voltage power source} divided by ({electrostatic capacity of said capacitor for smoothing mounted in said auxiliary high-voltage power source} added to {electrostatic capacity of said capacitor for smoothing mounted in said main high-voltage power source}); and a step of causing a second MOSFET to be turned ON when said third signal goes high at a fourth time, which causes said second contact to be discharged and a voltage at said second contact to reach a level of a ground potential, and when said operation is repeated, a voltage fed from said auxiliary high-voltage power source gradually drops and reaches 0 (zero) volts at a fifth time and, after a lapse of the time set at a time when power is turned off, a voltage fed from said low-voltage power source is lowered to 0 (zero) volts at a sixth time.

10. A plasma display comprising:

a power source used to produce power from a low-voltage power source and a main high-voltage power source;

a display section having a plasma display panel, an X driver and a Y driver each being used to drive said plasma display panel, a signal control circuit, a voltage detecting circuit used to detect a voltage fed from said main high-voltage power source and an auxiliary high-voltage power source; wherein, i) a state of power-off is detected by using said voltage detecting circuit used to detect a voltage fed from said main high-voltage power source while power is off and ii) said X driver or said Y driver, used to drive said plasma display panel, operates to discharge electrical charges being left in said auxiliary high-voltage power source through a resistor-free path.

11. The plasma display according to claim 10, wherein a drop in a voltage fed from said main high-voltage power source is detected while power is off and a method of driving said X driver is changed to discharge said electrical charges being left in said auxiliary high-voltage power source.

12. The plasma display according to claim 10, wherein a drop in a voltage fed from said main high-voltage power source is detected while power is off and a method of driving said Y driver is changed to discharge said electrical charges being left in said auxiliary high-voltage power source.

13. The plasma display according to claim 11, wherein a supply of power fed from said main high-voltage power source and said auxiliary high-voltage power source is stopped when power is turned off at a first time and a voltage is maintained by using electrical charges being left in a capacitor for smoothing mounted in said main high-voltage power source and said auxiliary high-voltage power source and wherein said voltage detecting circuit operates to output a first signal after a voltage fed from said main high-voltage power source drops and when a voltage at a first contact reaches a level predetermined by said voltage detecting circuit and wherein said signal control circuit having received said first signal repeatedly produces a second signal and a third signal being out of phase with each other, and wherein a first MOSFET (Metal Oxide Semiconductor Field Effect Transistor) is turned ON when said second signal goes high at a third time, which causes a voltage level at a second contact and a level of a voltage fed from said auxiliary high-voltage power source to reach {electrostatic capacity of said capacitor for smoothing mounted in said auxiliary high-voltage power source} multiplied by {potential of said auxiliary high-voltage power source} divided by ({electrostatic capacity of said capacitor for smoothing mounted in said auxiliary high-voltage power source} added to {electrostatic capacity of said capacitor for smoothing mounted in said main high-voltage power source}), and wherein a second MOSFET is turned ON when said third signal goes high at a fourth time, which causes said second contact to be discharged and a voltage at said second contact to reach a level of a ground potential, and when said operation is repeated, a voltage fed from said auxiliary high-voltage power source gradually drops and reaches 0 (zero) volts at a fifth time and, after a lapse the time set at a time when power is turned off, said voltage fed from said low-voltage power source is lowered to 0 (zero) volts at a sixth time.

14. The plasma display according to claim 12, wherein a supply of power fed from said main high-voltage power source and said auxiliary high-voltage power source is stopped when power is turned off at a first time and a voltage is maintained by using electrical charges being left in a capacitor for smoothing mounted in said main high-voltage power source and said auxiliary high-voltage power source and wherein said voltage detecting circuit operates to output a first signal after a voltage fed from said main high-voltage power source drops and when a voltage at a first contact reaches a level predetermined by said voltage detecting circuit and wherein said signal control circuit having received said first signal repeatedly produces a second signal and a third signal being out of phase with each other, and wherein a first MOSFET (Metal Oxide Semiconductor Field Effect Transistor) is turned ON when said second signal goes high at a third time, which causes a voltage level at a second contact and a level of a voltage fed from said auxiliary high-voltage power source to reach {electrostatic capacity of said capacitor for smoothing mounted in said auxiliary high-voltage power source} multiplied by {potential of said auxiliary high-voltage power source} divided by {electrostatic capacity of said capacitor for smoothing mounted in said auxiliary high-voltage power source} added to {electrostatic capacity of said capacitor for smoothing mounted in said main high-voltage power source} ), and wherein a second MOSFET is turned ON when said third signal goes high at a fourth time, which causes said second contact to be discharged and a voltage at said second contact to reach a level of a ground potential, and when said operation is repeated, a voltage fed from said auxiliary high-voltage power source gradually drops and reaches 0 (zero) volts at a fifth time and, after a lapse the time set at a time when power is turned off, said voltage fed from said low-voltage power source is lowered to 0 (zero) volts at a sixth time.

15. The plasma display of claim 10, wherein said X driver or said Y driver, used to drive said plasma display panel, operates to discharge electrical charges being left in said auxiliary high-voltage power source by using electrical charges left in a capacitor for smoothing mounted in said main high-voltage power source and said auxiliary high-voltage power source.

16. A plasma display comprising:

a power source used to produce power from a low-voltage power source and a main high-voltage power source;

a display section having a plasma display panel, an X driver and a Y driver each being used to drive said plasma display panel, a signal control circuit, a voltage detecting circuit used to detect a voltage fed from said main high-voltage power source and an auxiliary high-voltage power source; wherein, i) a state of power-off is detected by using said voltage detecting circuit used to detect a voltage fed from said main high-voltage power source while power is off and ii) said X driver or said Y driver, used to drive said plasma display panel, operates to discharge electrical charges being left in said auxiliary high-voltage power source, wherein a supply of power fed from said main high-voltage power source and said auxiliary high-voltage power source is stopped when power is turned off at a first time and a voltage is maintained by using electrical charges being left in a capacitor for smoothing mounted in said main high-voltage power source and said auxiliary high-voltage power source and wherein said voltage detecting circuit operates to output a first signal after a voltage fed from said main high-voltage power source drops and when a voltage at a first contact reaches a level predetermined by said voltage detecting circuit and wherein said signal control circuit having received said first signal repeatedly produces a second signal and a third signal being out of phase with each other, and wherein a first MOSFET (Metal Oxide Semiconductor Field Effect Transistor) is turned ON when said second signal goes high at a third time, which causes a voltage level at a second contact and a level of a voltage fed from said auxiliary high-voltage power source to reach {electrostatic capacity of said capacitor for smoothing mounted in said auxiliary high-voltage power source} multiplied by {potential of said auxiliary high-voltage power source} divided by ({electrostatic capacity of said capacitor for smoothing mounted in said auxiliary high-voltage power source} added to {electrostatic capacity of said capacitor for smoothing mounted in said main high-voltage power source}), and wherein a second MOSFET is turned ON when said third signal goes high at a fourth time, which causes said second contact to be discharged and a voltage at said second contact to reach a level of a ground potential, and when said operation is repeated, a voltage fed from said auxiliary high-voltage power source gradually drops and reaches 0 (zero) volts at a fifth time and, after a lapse the time set at a time when power is turned off, said voltage fed from said low-voltage power source is lowered to 0 (zero) volts at a sixth time.

17. A method for driving a plasma display comprising a main high-voltage power source, a low-voltage power source, an auxiliary high-voltage power source, a plasma display panel, an X driver and a Y driver each driving said plasma display panel, a signal control circuit, a voltage detecting circuit to detect power-off of said main high-voltage power source based on a voltage fed from said main high-voltage power source, at least any one of said X driver and said Y driver including a first transistor and a second transistor in series between said auxiliary high-voltage source and a ground and a first capacitor, one terminal of which is connected between said first transistor and said second transistor, and another terminal of which is connected to said ground, said method comprising the steps of:

producing a first signal to switch on said first transistor during a first period of time, and a second signal to switch on said second transistor during a subsequent second period of time by using said signal control circuit, when the power-off of said main high-voltage power source has been detected by said voltage detecting circuit; and feeding the produced first signal to said first transistor during said first period of time, and the produced second signal to said second transistor during said second period of time, whereby, remaining electric charges accumulated in said auxiliary high-voltage power source is transferred and discharged to said first capacitor, while said first transistor is switched on, whereas electric charges accumulated in said first capacitor is transferred and discharged to said ground, while said second transistor is subsequently switched on.

18. The method for driving the plasma display according to claim 17, wherein said auxiliary high-voltage power source has a second capacitor for smoothing a voltage to be output therefrom, in which said remaining electric charges are accumulated.

19. The method for driving the plasma display according to claim 17, wherein said main high-voltage power source has a third capacitor for smoothing a voltage to be output therefrom.

20. The method for driving the plasma display according to claim 17, wherein said first period of time and said second period of time are alternately repeated a plurality of times.

21. The method for driving the plasma display according to claim 17, wherein after said first period of time and said second period of time have been alternately repeated a plurality of times, a voltage output from said low-voltage power source is lowered to zero volts.

22. A plasma display comprising a main high-voltage power source, a low-voltage power source, an auxiliary high-voltage power source, a plasma display panel, an X driver and a Y driver each driving said plasma display panel, a signal control circuit, a voltage detecting circuit to detect power-off of said main high-voltage power source based on a voltage fed from said main high-voltage power source, at least any one of said X driver and said Y driver including a first transistor and a second transistor in series between said auxiliary high-voltage source and a ground and a first capacitor, one terminal of which is connected between said first transistor and said second transistor, and another terminal of which is connected to said ground, wherein, when the power-off of said main high-voltage power source has been detected by said voltage detecting circuit, said signal control circuit produces a first signal to switch on said first transistor and feeds the produced first signal to said first transistor during a first period of time, and produces a second signal to switch on said second transistor and feeds the produced second signal to said second transistor during a subsequent second period of time, whereby remaining electric charges accumulated in said auxiliary high-voltage power source is transferred and discharged to said first capacitor, while said first transistor is switched on, whereas electric charges accumulated in said first capacitor is transferred and discharged to said ground, while said second transistor is subsequently switched on.

23. The plasma display according to claim 22, wherein said auxiliary high-voltage power source has a second capacitor for smoothing a voltage to be output therefrom, in which said remaining electric charges are accumulated.

24. The plasma display according to claim 22, wherein said main high-voltage power source has a third capacitor for smoothing a voltage to be output therefrom.

25. The plasma display according to claim 22, wherein said first period of time and said second period of time are alternately repeated a plurality of times.

26. The plasma display according to claim 22, wherein after said first period of time and said second period of time have been alternately repeated a plurality of times, a voltage output from said low-voltage power source is lowered to zero volts.

* * * * *